US005377974A

United States Patent [19]

Rodriguez Rivera

[11] Patent Number: 5,377,974

[45] Date of Patent: Jan. 3, 1995

[54] HOOP BALANCING GAME

[76] Inventor: Angel L. Rodriguez Rivera, Calle Clavel 3-J-17, Lomas Verdes, Bayamón, Puerto Rico, 00956

[21] Appl. No.: 133,265

[22] Filed: Oct. 7, 1993

Related U.S. Application Data

[63] Continuation of Ser. No. 64,929, May 24, 1993, abandoned.

[51] Int. Cl.[6] ..... A63F 7/00

[52] U.S. Cl. ..... 273/126 R; 273/108; 273/449

[58] Field of Search ..... 273/126 R, 126 A, 108, 273/449, 440; 446/236

[56] References Cited

U.S. PATENT DOCUMENTS

| | | | |
|---|---|---|---|
| D. 161,081 | 12/1950 | Bazelon . | |
| 1,098,360 | 5/1914 | Geary | 273/108 |
| 2,021,395 | 11/1935 | Watmough | 273/440 |
| 3,542,366 | 11/1970 | Schoker | 273/108 |
| 3,600,843 | 8/1971 | Becker | 273/108 X |
| 3,785,652 | 1/1974 | Ghovanloo . | |
| 4,247,110 | 1/1981 | Mazuela . | |
| 4,257,602 | 3/1981 | Seath . | |
| 4,257,603 | 3/1981 | Harding . | |
| 4,561,656 | 12/1985 | David . | |

FOREIGN PATENT DOCUMENTS

| | | | |
|---|---|---|---|
| 1200715 | 9/1965 | Germany | 273/126 |

*Primary Examiner*—Vincent Millin
*Assistant Examiner*—Raleigh W. Chiu
*Attorney, Agent, or Firm*—Jacobson, Price, Holman & Stern

[57] ABSTRACT

A string or cord is tied between two vertical surfaces. A hoop is rolled across the stretched string in an attempt to balance the hoop as it travels from one end of the string to an opposite end of the string. On a peripheral edge of the hoop, a concave groove is formed so as to engage the string as the hoop is rolled across the string. Depending upon the depth and width of the groove, the degree of difficulty in rolling the hoop across the string is varied. In a preferred embodiment, the string is stretched across a game table, so if the hoop falls off of the string or even if the hoop completes its journey across the string, the hoop falls onto an elevated surface from which the hoop may be retrieved. To assist a player in retrieving the hoop, a hooked rod may be used.

9 Claims, 3 Drawing Sheets

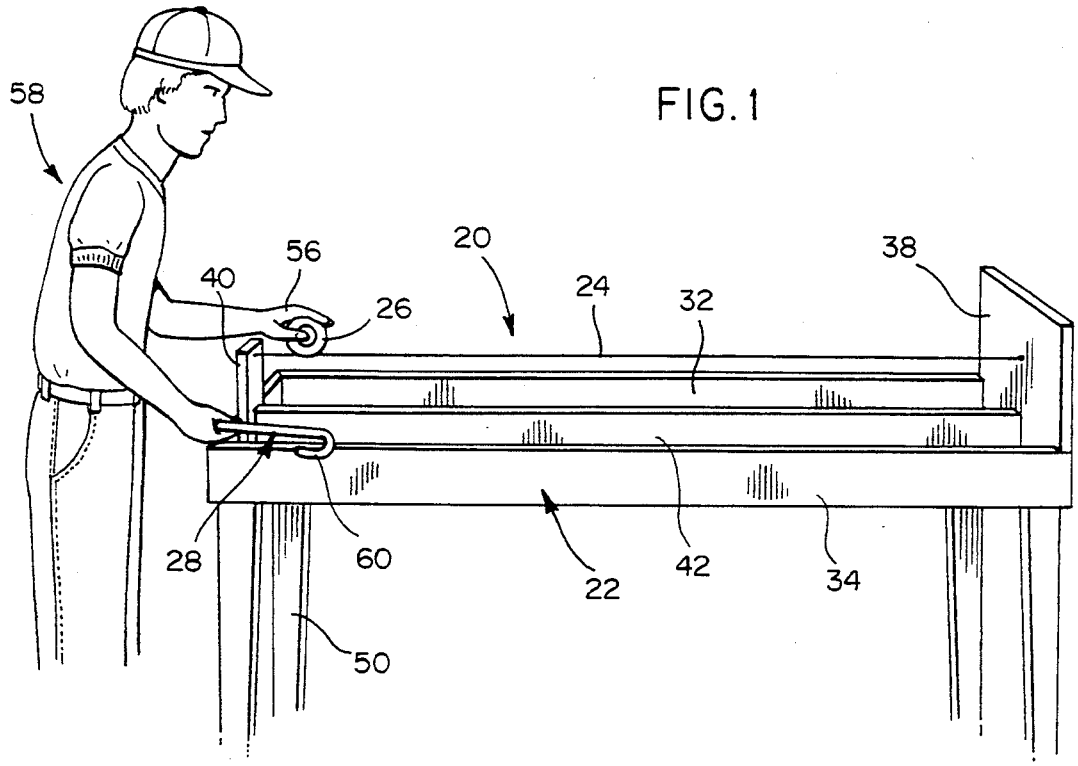
FIG. 1
FIG. 4
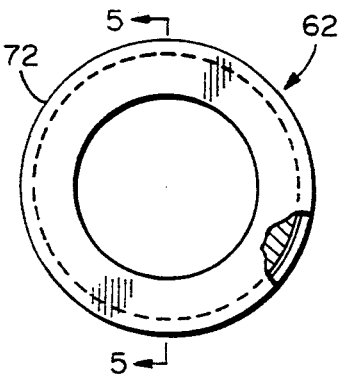
FIG. 6
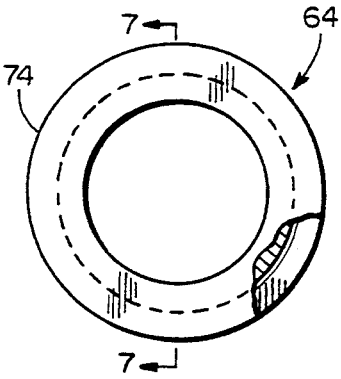
FIG. 8
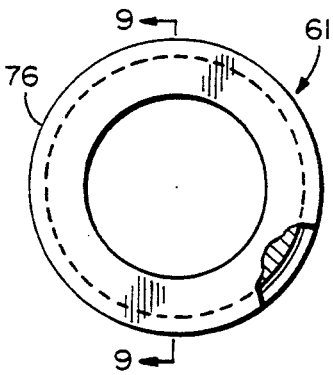
FIG. 5
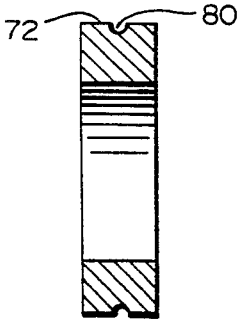
FIG. 7
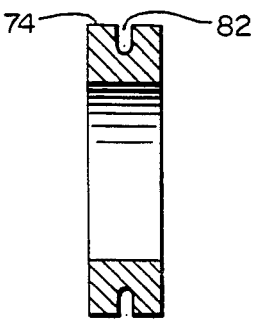
FIG. 9
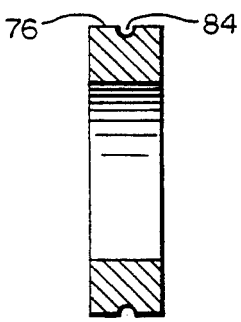

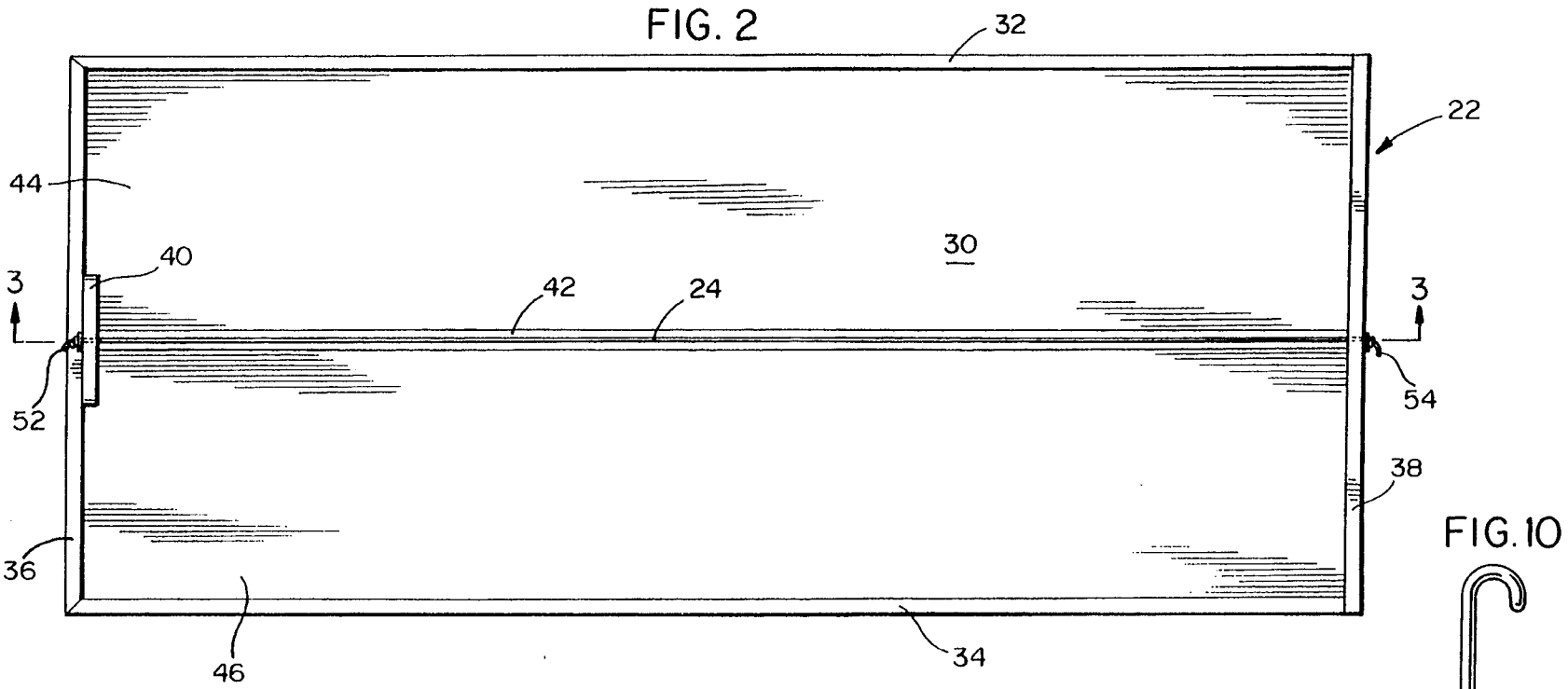
FIG. 2
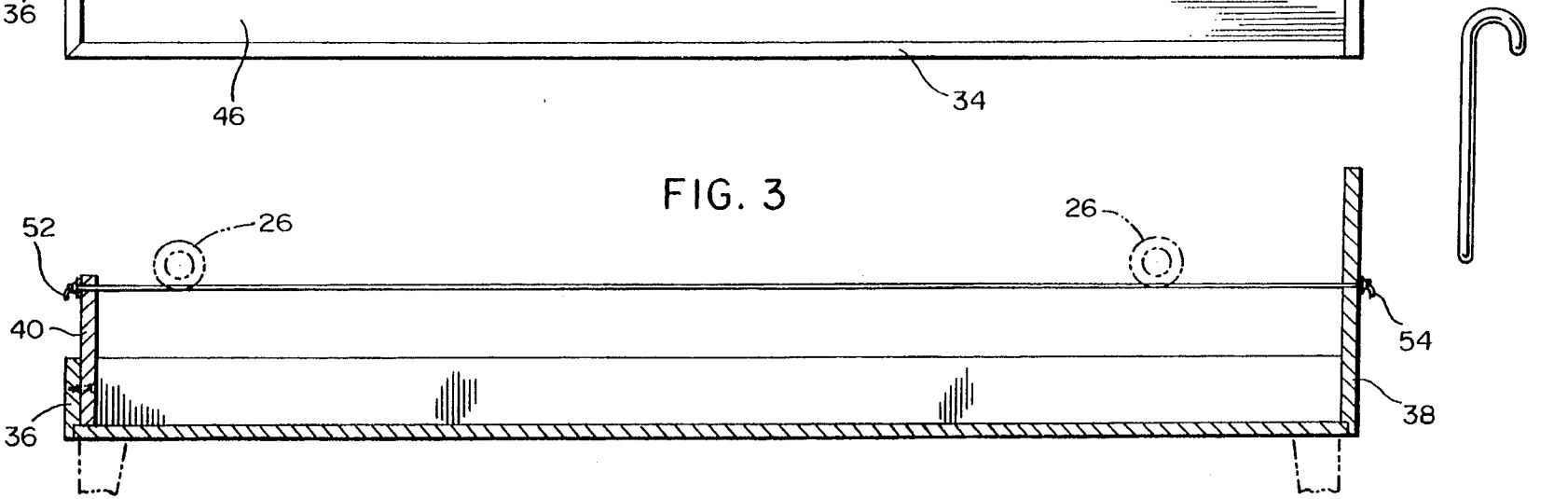
FIG. 3
FIG. 10

HOOP BALANCING GAME

This application is a continuation of application Ser. No. 08/064,929, filed May 24, 1993 now abandoned.

FIELD OF THE INVENTION

This invention relates to a game for developing skill and coordination by balancing a hoop having a peripheral groove across a length of stretched string.

BACKGROUND OF THE INVENTION

Many games attempt to develop eye-hand coordination for adults and also for children. These games take various forms and are often complicated in design and are difficult to master.

SUMMARY OF THE INVENTION

By the present invention, a string or cord is tied between two vertical surfaces. A hoop is rolled across the stretched string in an attempt to balance the hoop as it travels from one end of the string to an opposite end of the string.

On a peripheral edge of the hoop, a concave groove is formed so as to engage the string as the hoop is rolled, across the string. Depending upon the depth and width of the groove, the degree of difficulty in rolling the hoop across the string is varied.

In a preferred embodiment, the string is stretched across a game table, so if the hoop falls off of the string or even if the hoop completes its journey across the string, the hoop falls onto an elevated surface from which the hoop may be retrieved. To assist a player in retrieving the hoop, a hooked rod may be used.

The object of the game is to slide the hoop from one end to the other of an extended string. As soon as a player has control over a hoop of a particular degree of difficulty, as determined by the depth and width of a peripheral groove, the degree of difficulty may be increased by using a hoop having a lesser depth or width groove so as to challenge the player and increase their skill and concentration in achieving the goals of the game. This game may be played as a competitive game and include one to four players, for example.

The game table upon which the string is stretched is in the form of a rectangular box which prevents the hoops from rolling across the floor and away from the players. A reinforcement bar extending across the game table subdivides the game table into two sections so as to facilitate retrieval of a fallen hoop from either side of the table without having to reach across a midpoint of the table from one side.

The length of string used is dependent upon the distance between the vertical surfaces between which the string is stretched. Also, as a factor in varying the difficulty of the game, the diameter of the string may be varied.

The hoops used are made from plastic, metal or wood. The diameter of the hoops and the width and depth of the groove which terminates in a predetermined radius will depend upon the diameter of the string used.

In one example, when the game has been mastered using the smallest possible size groove, which would be equal to a semi-circular configuration equal to an area half the area of a cross-section of the stretched string, it is possible to use a hoop with no groove, only a flat peripheral surface, which is attempted to be rolled across the string.

The game table can be made of plastic, wood or any other material. The overall length of the game table can be varied to accommodate a particular degree of difficulty for rolling a hoop across a stretched string.

The hook used to retrieve the hoop once the hoop has fallen into the game table may be made of plastic. The hook is approximately twenty-four inches long with a diameter of approximately three-thirty seconds of an inch.

It is also possible to play the game without the use of a game table. In this alternative embodiment, two cord supports are used between which is stretched a string which can have a separation distance of four feet, ten feet, twenty feet or thirty feet. In this embodiment, the game can be played outdoors in a grassy area.

It is an object of the present invention to provide a game for increasing the skill and eye-hand coordination of a player.

It is another object of the present invention to provide a game for increasing the skill and eye-hand coordination of a player with a string stretched between two vertically-extending string supports with a plurality of hoops having a groove in a peripheral surface of varying depths and radii rolled across the stretched string.

It is yet another object of the present invention to provide a game for increasing the skill and eye-hand coordination of a player with a string stretched between two vertically-extending string supports with the string supports mounted on a game table with a plurality of hoops having a groove in a peripheral surface of varying depths and radii rolled across the stretched string.

It is still yet another object of the present invention to provide a game for increasing the skill and eye-hand coordination of a player with a string stretched between two vertically-extending string supports with the string supports mounted on a game table elevated above the floor with a plurality of hoops having a groove in a peripheral surface of varying depths and radii rolled across the stretched string.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 illustrates a game table having a stretched string and a hoop to be rolled across the stretched string by a player.

FIG. 2 is a plan view of the game table.

FIG. 3 is a sectional view taken along line 3—3 of FIG. 2.

FIG. 4 illustrates a first example of a hoop.

FIG. 5 is a sectional view taken along line 5—5 of FIG. 4.

FIG. 6 is a second example of a hoop.

FIG. 7 is a sectional view taken along line 7—7 of FIG. 6.

FIG. 8 is a third example of a hoop.

FIG. 9 is a sectional view taken along line 9—9 of FIG. 8.

FIG. 10 illustrates a retrieval hook.

DETAILED DESCRIPTION OF THE PREFERRED EMBODIMENTS

Figure 11:
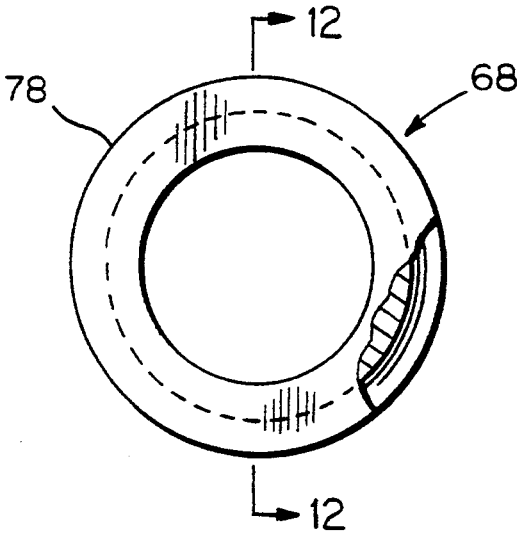
FIG. 11 illustrates a fourth example of a hoop.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 3, in particular, a hoop balancing game is generally designated as 20. With reference to its orientation in FIG. 1, the hoop balancing game includes a game table 22, a stretched string 24, a hoop 26 and a retrieval hook 28.

The game table 22 includes an upper flat surface 30 having two side walls 32 and 34 projecting above the upper flat surface 30. Of a same height as the side walls 32 and 34 is an end wall 36. Opposite to the end wall 36 is an end wall 38 having a greater height than the end wall 36 and being referred to as a string support wall. Secured to end wall 36 and projecting above end wall 36 is string support 40.

Extending between string support 40 and string support wall 38 is a reinforcement rail 42 which divides the upper flat surface 30 into sections 44 and 46. The table 22 includes four support legs 50 to elevate the table above the floor.

The stretched string 24 extends at one end 52 through string support 40 and is knotted so as to be secured at end 52 at the string support 40. The opposite end 54 of string 24 extends through string support 38 and is knotted so as to be secured to the string support 38. It is understood that the distance between string supports 38 and 40 can be increased or decreased and that the string supports could be used independently of a game table so as to stretch string 24 over a greater or lesser distance.

In FIG. 1, hoop 26 is shown being held in place on a string 24 by the hand 56 of a player 58. It is an object of the game to roll the hoop 26 as shown in dotted lines in FIG. 3, from adjacent to cord support 40 to cord support 38 without the hoop 26 falling off of the string 24.

If the hoop 26 does fall off of the string 24, retrieval hook 28 is used to retrieve the hoop 26 by engagement of the hooked end 60 of the retrieval hook 28. The hoop 26 can fall into either of sections 44 or 46 so the player will know which side 32, 34 of the table the player should proceed to in order to retrieve the fallen hoop 26. The reinforcement rail 42 divides the upper flat surface 30 into two sections and thereby assists the player in determining which side of the table to proceed to in order to retrieve a fallen hoop 26.

Figure 12:
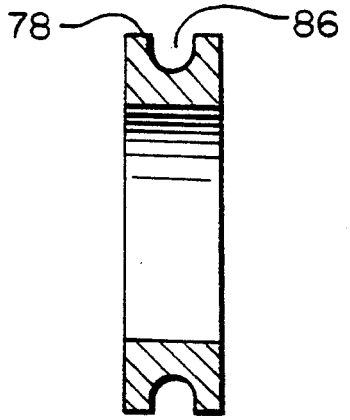
FIG. 12 is a sectional view taken along line 12—12 of FIG. 11.
Figure 13:
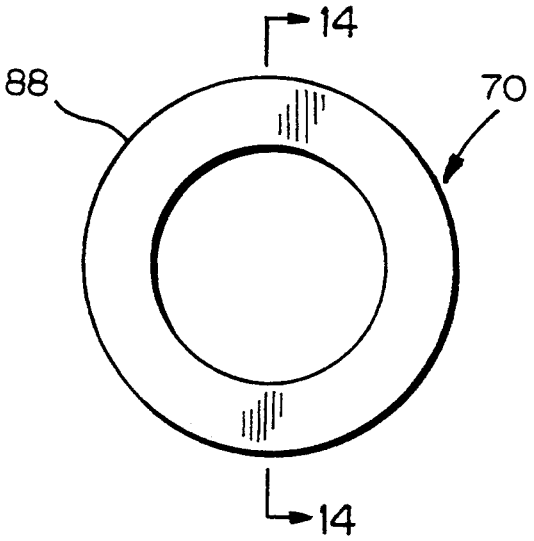
FIG. 13 is a fifth example of a hoop.
Figure 14:
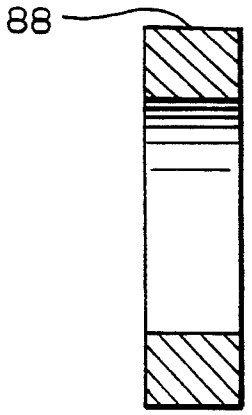
FIG. 14 is a sectional view taken along line 14–14 of FIG. 13.

To vary the degree of difficulty of the game, various hoops are employed. Typically, a hoop will have an outside diameter of two inches and an inside diameter of one-and-one-quarter inches with a thickness of one-half inch. With reference to FIGS. 4 through 9 and 11 through 14, rings 62, 64, 66, 68, and 70, are shown. Defined in a peripheral surface 72, 74, 76, and 78 of rings 62, 64, 66 and 68, respectively, is a groove 80, 82, 84, 86.

Groove 80 has a depth of three-thirty seconds of an inch and a radius of three-thirty seconds of an inch. Groove 82 has a depth of three-sixteenths of an inch and a radius of three-thirty seconds of an inch. Groove 84 has a depth of one-eighth of an inch and a radius of one-eighth of an inch. Groove 86 has a depth of three-sixteenths of an inch and a radius of five-thirty seconds of an inch. The peripheral surface 88 of hoop 70 is flat and devoid of any grooves.

By changing hoops, the difficulty of a hoop traversing a string 24 is varied. Hoop 70, having no groove, is the most difficult hoop to roll between one end 52 of string 24 towards an opposite end 54 of string 24.

In one example of the game, the game table has a length of forty-eight inches, a width of twenty-one inches, a height of three inches and is made of one-quarter inch thick wood stock. At opposite ends of the table, two string supports project above the table having a width of three inches, a height of six inches and a thickness of three-quarter of an inch. A central partition extends down the middle of the table with a length of forty-eight inches, a height of three inches and a width of one inch. The stretched string extending between the string supports is made of nylon having a diameter of three-sixteenths of an inch.

Five hoops are used having an exterior diameter of two inches and an interior diameter of one-and-one-quarter inch. Each hoop is one-half inch thick. The first hoop has a groove of three-sixteenths of an inch deep and a radius of three-thirty seconds inches, the second hoop has a groove of a depth of one-eighth inch and a radius of one-eighth inch, the third hoop has a groove of a depth of three-thirty seconds of an inch and a radius of three-thirty seconds of an inch. The fourth hoop has a groove of a depth of three-sixteenths of an inch and a radius of five-thirty seconds of an inch. A peripheral surface of the fifth hoop is flat. The hook used to retrieve a fallen hoop is twenty-four inches long and has a diameter of three-thirty seconds of an inch.

Having described the invention, many modifications thereto will become apparent to those skilled in the art to which it pertains without deviation from the spirit of the invention as defined by the scope of the appended claims.

I claim:

1. A balancing game comprising:
   two string supports spaced from each other,
   a string stretched between said two string supports and secured at opposite ends to said two string supports, and
   a plurality of hoops having a groove in a peripheral surface for rolling along said string in a balanced condition in an attempt to prevent falling of each of said plurality of hoops from said string.

2. A balancing game according to claim 1, wherein said two string supports are mounted on a game table.

3. A balancing game according to claim 2, wherein said game table includes legs to elevate said game table above the floor.

4. A balancing game according to claim 3, wherein a partition rail divides said game table into two sections.

5. A balancing game according to claim 4, wherein said partition rail is centrally located on said game table.

6. A balancing game according to claim 2, further comprising a hook for retrieving a hoop from said game table.

7. A balancing game according to claim 1, further comprising an additional hoop having a flat peripheral surface.

8. A balancing game according to claim 1, wherein said plurality of hoops have an outside diameter of two inches and an inside diameter of one-and-one-quarter inches.

9. A balancing game according to claim 1, wherein said string is four feet long.

* * * * *